United States Patent [19]

Green

[11] 4,365,310

[45] Dec. 21, 1982

[54] OPTICAL HOMODYNE PROCESSOR

[75] Inventor: Eugene L. Green, New London, Conn.

[73] Assignee: The United State of America as represented by the Secretary of the Navy, Washington, D.C.

[21] Appl. No.: 192,750

[22] Filed: Oct. 1, 1980

[51] Int. Cl.[3] ..... G06G 7/195; G06G 9/00

[52] U.S. Cl. ..... 364/822; 350/162 SF; 350/358; 364/827; 364/837

[58] Field of Search ..... 364/822, 826, 827, 837, 364/713, 576; 350/162 SF, 3.68, 3.83, 332, 358, 384

[56] References Cited

U.S. PATENT DOCUMENTS

| | | | |
|---|---|---|---|
| 3,694,657 | 9/1972 | Brooks | 364/822 |
| 3,872,293 | 3/1975 | Green | 364/827 |
| 4,225,938 | 9/1980 | Turpin | 350/162 SF X |

*Primary Examiner*—Joseph F. Ruggiero
*Attorney, Agent, or Firm*—R. F. Beers; P. C. Lall

[57] ABSTRACT

An analog optical processor which performs complex transform operations or complex correlations to yield quantitative (numerical) output. This is accomplished on data points which are used as inputs serially or simultaneously. The dynamic range of the input function that may be operated upon is not limited, as heretofore, by the characteristics of a medium on which the input function is recorded or stored. The dynamic range of the output is also not limited by the characteristics of a discrete electro-optical sensor.

10 Claims, 6 Drawing Figures

OPTICAL HOMODYNE PROCESSOR

BACKGROUND OF THE INVENTION

The present invention relates to optical processors and more particularly to an analog optical processor which requires no light modulator to transduce input electrical signals to optical signals and which uses homodyne detection to maximize dynamic readout of the optical transformed operator.

Complex integral transform operations have been performed by conventional optical processors which require the input signals, one-dimensional or two-dimensional, constituting a spatial matrix of elements. At each of the elements of the spatial matrix, the amplitude and/or phase light may be changed proportionally to an input signal. All elements of the input signal operate simultaneously on the input beam of light. The amplitude transmittance of each element must be modulatable to provide for processing of new signals in a rapid sequence. Heretofore, the application of optical integral transform devices has been inhibited by lack of sufficient means of modulating a light beam with an input signal. Typical light modulators such as ferro-electrics, thermoplastics, photochromics and liquid crystals are subject to degradation or fatigue in use. Furthermore, the dynamic range of the input signal that may be accommodated by such a modulator is limited. A maximum of approximately ten levels is typical, equivalent to a few bits per input element. It is thus desirable to have an apparatus and method for complex filtering of one or two-dimensional signals for complex operations at high speed by an optical-electronic processor which can utilize high density optical read-only or interactive memory.

SUMMARY OF THE INVENTION

An analog optical processor according to the teachings of subject invention performs complex Fourier plane filtering and other integral transform operations by using homodyne or alternating current detection. In subject processor, direction of an input light beam is equivalent to an argument of the input function. However, the input data need not modulate light. Spatial modulation of light is done by only the optical integral transform operator which may incorporate a large optical memory in the form of a complex Fourier transform hologram filter. Optical readout of the complex operator is done at a single matrix of light sensors. The processor includes input function $f(\tau_j)$, a sample of input function $f(\tau)$ from a source generator, which is multiplied in a multiplier by the output of a frequency $$\sum_{j=1}^{m} \cos \omega_j t$$

generator and is also multiplied in another multiplier by the output of another frequency generator through a phase shifter, thus producing m samples of input $f(\tau_j)$ which are used as input simultaneously (parallel input). For m samples, m applications of these operations are implemented. The output of a light sensor is divided by a signal divider into equal parts which are used as inputs to the multiplier with their outputs being used as input respectively to two integrators. The output of the integrators gives respectively the real and imaginary parts of the complex output of the processor which is stored in a memory system.

An object of subject invention is to provide an improved method of complex filtering of one or two-dimensional signals at high speeds by an optical-electronic processor.

Still another object of subject invention is to overcome inherent limitations of previous optical processors pertaining to the fatigue effects.

Still another object of subject invention is to have an electro-optical electronic processor which does not need any light modulator to input any electrical signals to optical signals.

Still another object of subject invention is to have an optical electronic processor which uses homodyne detection rather than power detection in order to maximize dynamic range in readout of the optical transform operator.

Other objects, advantages and novel features of this invention will become apparent from the following detailed description of the invention when considered in conjunction with the accompanying drawings wherein:

DESCRIPTION OF PREFERRED EMBODIMENTS

Figure 1:
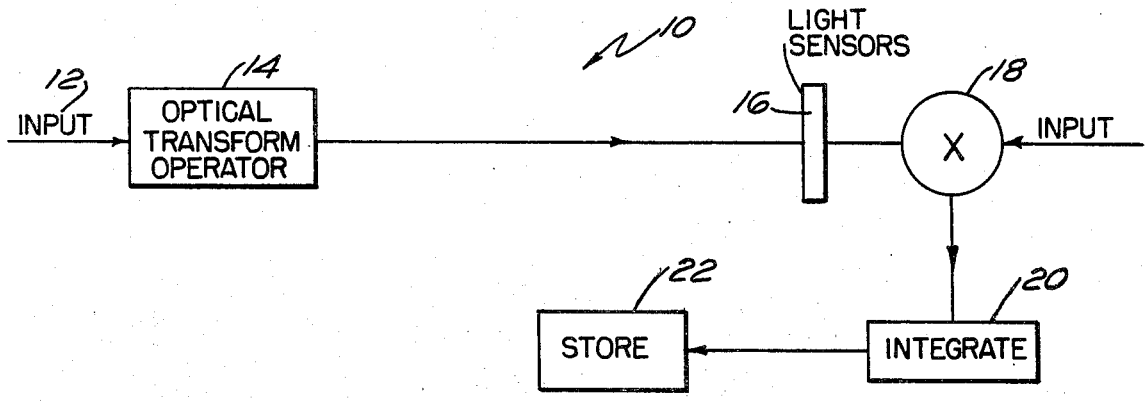
FIG. 1 shows a block diagram of the optical-electronic processor of subject invention.

For the purpose of promoting the understanding of the principles of subject invention, reference will now be made to the embodiments illustrated in the drawings and specific language will be used to describe them. It will nevertheless be understood that no limitation of the scope of the invention is hereby intended. Any further modifications in the illustrated devices, and such further applications of the principles of the invention as illustrated as would normally occur to one skilled in the art to which the invention relates will be presumed.

Referring now to FIG. 1, there is shown schematically a block diagram of the optical processor 10 built according to the teachings of subject invention. FIG. 1 describes the fundamental mathematical operations performed by the new processor 10 on a two-dimensional input function. The processor operates on independently entered beams of light 12, each of which is associated with an argument pair (x,y) of the input signal. The optical transform operator 14 is inherently two-dimensional. Two-dimensional functions such as f(x,y) include sets of one-dimensional functions, which may be represented $f_i(x)\delta(y-a_i)$. The argument pairs (x,y) of the input function f(x,y) are used as inputs as independent beams of light 12, to the optical transform operator 14.

At the output (k,l) plane, where a two-dimensional matrix of light sensors 16 is placed, the optical transform operator 14 causes a light amplitude and phase distribution, g(x,y,k,l), to spatially modulate each input light beam (x,y). Each light sensor (k,l) of the matrix of light sensors gives as an output a complex multiplier given by $$g(x,y,k,l) = b_{x,y,k,l}e^{iB_{x,y,k,l}}$$

wherein g(x,y) multiplies input signal f(x,y) by means of electrical analog multiplier 18, which gives as output g(x,y,k,l)f(x,y) to integrator 20. Integrator 20 sums over (x,y) and outputs the integral transform evaluated at each element (k,l) of output sensor matrix 16. In the store 22, outputs derived thus from all sensor elements of the light sensor matrix 16 are accumulated, constituting thereby the function F(k,l) defined as $$F(k,l) = \int_x \int_y g(x,y,k,l)f(x,y)dxdy$$

whereas g(x,y,k,l) may be independent of time or may be a slowly varying function of time, which is essentially constant during the integration represented by the above equation.

Figure 2:
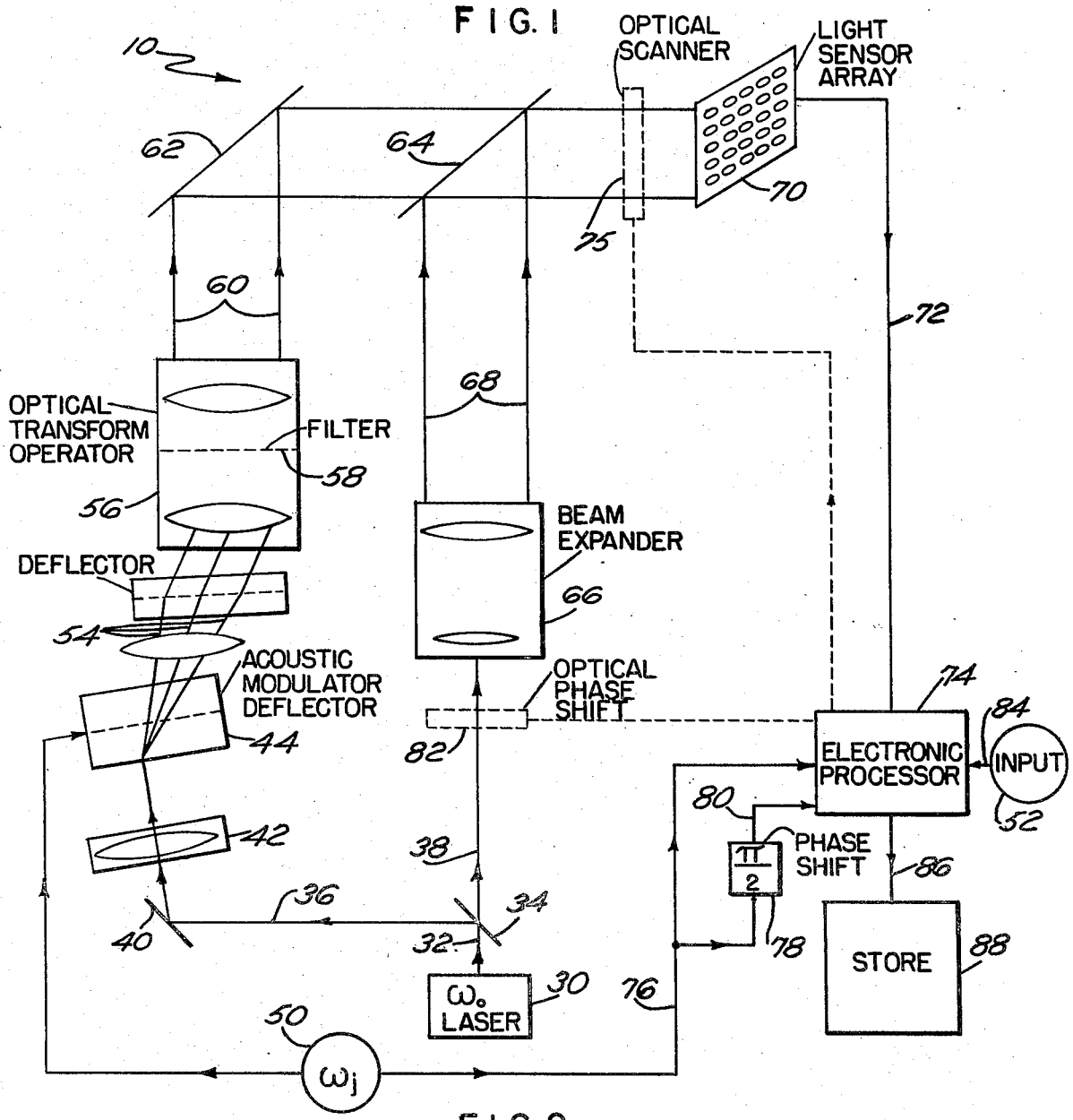
FIG. 2 is a detailed block diagram of the new processor for use in case of inputs which are functions of one variable.

FIG. 2 is a more detailed diagram of the new processor 10 in a form suited to use of one variable input function. It has been remarked that the operation of the processor on a one-dimensional function is inherently a two-dimensional operation. Laser 30 generates light beam 32, which has optical frequency $\omega_o$. Beam splitter 34 divides light beam 32 into light beams 36 and 38. Beam 36 is directed by mirror 40 through cylindrical beam expander 42 to acoustic modulator-deflector 44. The acoustic modulator-deflector 44 may be a device which operates on the principle of Bragg diffraction by a traveling acoustic wave, such as the Zenith Model D-70R. The function of the cylindrical beam expander 42 is to match the shape of the collimated light beam from laser 30 to the entrance aperture of the acoustic modulator-deflector 44. Subcarrier generator 50 generates m discrete frequencies (cos $\omega_j t$), which cause traveling waves in acoustic modulator-deflector 44. The traveling waves are associated with temporal frequencies, $\omega_1 \ldots \omega_j \ldots \omega_m$. These frequencies may be generated either simultaneously or sequentially. The m subcarrier frequencies, $\omega_j$, are high frequencies relative to the dominant frequency $\omega_s$ content of the signal from signal souce 52 which is to be operated upon. The subcarrier frequencies are low frequencies compared to the optical carrier, $\omega_o$.

$$\omega_s << \omega_j << \omega_o$$

The m frequencies act independently by means of modulator-deflector 44 to modulate and deflect a set of m light beams, each of which is modulated by the subcarrier, $\omega_j$, corresponding to its angle of deflection. Thus the output of the modulator-deflector 44 is a set of m light beams 54. The light beams 54 pass through optical integral transform operator 56, which may perform a Fourier transform operation or may incorporate complex Fourier transform filter 58. The optical integral transform operator 56 independently acts on each of the light beams 54. The transformed light beams 60 are the output of the optical integral transform operator 56 and are reflected by mirror 62 after which they pass through semi-reflecting mirror 64. Beam 38 is expanded by beam expander 66 to become reference beam 68, which is combined by semi-reflecting mirror 64 with transformed beams 60. The combined transformed beams 60 and reference beam 68 are incident on light sensor array 70, which detects signals that result from interaction of the two beams. The alternating current component of the signal 72 which includes the output of each element of the light sensor array at each frequency, $\omega_j$, consists of that subcarrier frequency shifted in phase and amplitude by the optical integral transform operator 56. The output 72 of light sensor array 70 is entered into electronic processor 74. Subcarrier frequencies 76 from subcarrier frequency generator 50 are entered directly into the electronic processor 74 and are also phase shifted 90 degrees by phase shifter 78, to be entered as phase shifted subcarrier frequencies 80. The direct and phase shifted signals may be entered into the electronic processor simultaneously (in parallel) or sequentially. It is possible, alternatively, to provide for sequential shift in phase by 90 degrees of the optical carrier $\omega_o$, i.e., of beam 38, which becomes reference beam 68, rather than the subcarrier $\omega_l$. This is done by means of phase shifter 82 controlled by electronic processor 74. The phase shifter 82 may be an electro-optic device based on Kerr or Pockels effect, or may be a mechanically operated optical element, such as a variable thickness plate. Input signals 84 from signal source 52 also enter electronic processor 74, which performs multiplications and summations to output integral transform 86 to store 88. Optical scanner 75 is used for sequential processing of individual sums of the signal beams and the reference beam.

The acoustic light modulator and deflector 44 of FIG. 2 imposes a subcarrier frequency $\omega_j$ on the light, which is deflected to a direction associated uniquely with $\omega_j$. The subcarrier frequency may be varied linearly with time so that at a time $\omega_j$ the associated frequency is $\omega_j$. In this case the rate of change of $\omega_j$ must be such that the change within the time, T, required for propagation of sound over the length of the aperture of the modulator-deflector is less than $2\pi/T$. ($\omega$ is expressed in units of radians/sec.) That is, $\Delta\omega$ must be less than the uncertainty of frequency associated with the finite length of the aperture. Alternatively, a set of subcarriers, $\omega_l \ldots \omega_j \ldots \omega_m$, may be applied simultaneously to the acoustic modulator-deflector, in which case each discrete frequency $\omega_j$, is associated with $\omega_j$, an argument of the sampled input function, which is sampled at equal intervals of the argument $\omega$. The subcarrier frequencies are chosen to be multiples of $2\pi/T$.

$$\omega_1 = S_1\frac{2\pi}{T}, \ldots \omega_j = S_j\frac{2\pi}{T} \ldots \omega_m = S_m\frac{2\pi}{T}$$

where the $S_j$ are integers.

A frequency $\omega_j$ applied to the modulator-deflector 44, which is an acoustic Bragg diffraction device, causes a travelling phase wave which moves in a direction normal to the direction of propagation of the incident collimated light beam. The $j^{th}$ acoustic wave may be described by.

$$h_j(t,x) = i_{aj}\cos(\omega_j t - k_j x)$$

$$= i_{aj}\frac{e^{i(\omega_j t - k_j x)} + e^{-i(\omega_j t - k_j x)}}{2}$$

where $a_j << 1$

The incident light beam is modulated by $h_j(t,x)$ spatially and temporally. Thus, $$H_j(t,x)=[1+h_j(t,x)]e^{i\omega_o t}$$

$H_j(t,x)$ represents the undiffracted wave plus two waves associated with wave numbers $-k$ and $+k$, modulated temporally by $e^{i\omega j t}$ and $e^{-i\omega j t}$. The direction cosines of two diffracted waves with respect to the incident wave normal are $\pm k_j\lambda_{o/2}$ *where* $\lambda_o$ is the wavelength of light. In operation of the Bragg diffraction device the diffracted light on one side of the undeviated beam is usually suppressed. In operation of this processor it will be assumed that only the diffracted wave corresponding to the optical sideband, $\omega_o+\omega_j$, will propagate through the optical transform operator to the output plane.

Consider the plane wave modulated temporally by: $W_j=e^{i(\omega_o+\omega_j)t}$. The optical integral transform operator 56 performs the following operation on $W_j$:

$$b_{jp}e^{iB_{jp}}(W_j)=\beta_{jp}(W_j)$$

where p represents the $p^{th}$ element of the output sensor array.

$$1 \leqq p \leqq n$$

The repeated subscript, j, does not imply summation here, but is merely an identifying subscript.

The reference beam $e^{i\omega_o t}$ is superimposed on the transformed beam in the output plane, giving the output for the $j^{th}$ input wave at the $p^{th}$ output sensor. The output consists of a direct current component plus an a.c. component.

$$\begin{aligned}\text{Output} &= (e^{i\omega_o t}+\beta_{jp})\,(e^{i\omega_o t}+\beta_{jp})^* \\ &= \text{const.} + 2_{bjp}\cos(\omega_j t + B_{jp}) \\ &= \text{const.} + 0_{jp}\end{aligned}$$

where $$\begin{aligned}0_{jp} &= 2b_{jp}\cos(\omega_j t + B_{jp}) \\ &= 2b_{jp}(\cos B_{jp}\cos\omega_j t - \sin B_{jp}\sin\omega_j t)\end{aligned}$$

Figure 3:
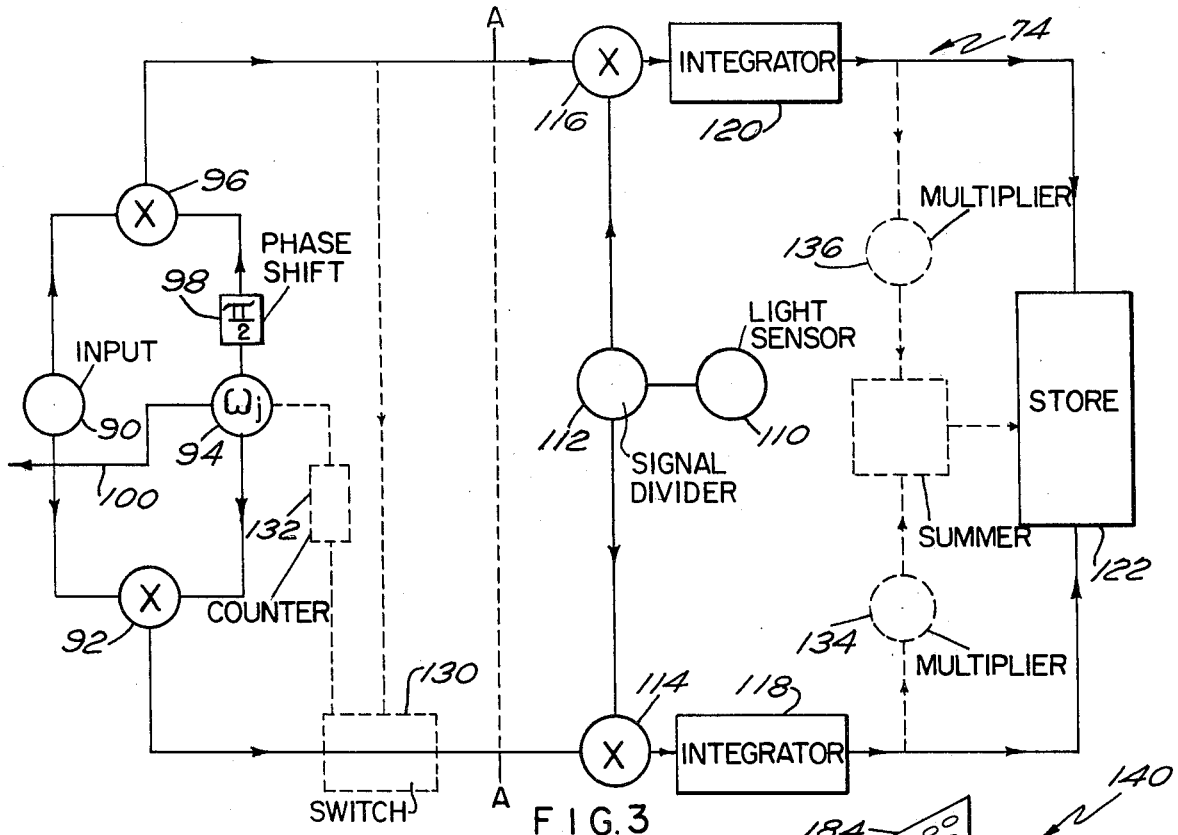
FIG. 3 is a simplified block diagram of an optical-electronic processor built according to the teachings of subject invention.

FIG. 3 is a diagram of the electronic processor 74 of FIG. 2. Input $f(\tau_j)$, a sample of input function, $f(\tau)$, from source 90 is multiplied in multiplier 92 by $$\sum_{j=1}^{m} \cos\omega_j t$$

from frequency generator 94; $f(\tau_j)$ is multiplied also in multiplier 96 by $$\sum_{j=1}^{m} -\sin\omega_j t$$

drived from frequency generator 94 through phase shifter 98. Frequency generator 94 provides signal 100 represented by:

$$\sum_{j=1}^{m} (\cos\omega_j t)$$

to the acoustic modulator-deflector 44 of FIG. 2. Frequency generator 94 of FIG. 3 is identical to frequency generator 50 of FIG. 2, which was shown outside the electronic processor 74 thereof. Elements 92, 96, and 98 of electronic processor to the left of dotted line AA need be implemented only once if the $f(\tau_j)$ are inputted sequentially. If m samples of $f(\tau_j)$ are inputted simultaneously (parallel input), then m replications of these elements must be implemented. The output, $O_{jp}$, of light sensor 110 is divided by signal divider 112 into equal parts, which are inputted to multipliers 114 and 116. The output of multiplier 92 is inputted to multiplier 114, and the output of multiplier 96 is inputted to multiplier 116. The outputs of 114 and 116 are respectively (for each subcarrier frequency)

$$\text{Output of 114: } \frac{O_{jp}}{2}\cos\omega_j t f(\tau_j)$$

$$\text{Output of 116: } \frac{0_{jp}}{2}\sin\omega_j t f(\tau_j)$$

Outputs of 114 and 116 are inputted respectively to integrators 118 and 120 where integration is performed over t and $\tau$. (Summation over j is equivalent to integration over $\tau$.)

$$\begin{aligned}\text{Output of 118: } &= \sum_{j=1}^{m} \int_o^T \frac{O_{jp(t)}}{2} f(\tau_j)\cos\omega_j t\, dt \\ &= \sum_{j=1}^{m} f(\tau j) b_{jp}\cos B_{jp} = O_{re}\end{aligned}$$

$$\begin{aligned}\text{Output of 120: } &= \sum_{j=1}^{m} \int_o^T -\frac{O_{jp(t)}}{2} f(\tau_j)\sin\omega_j t\, dt \\ &= \sum_{j=1}^{m} f(\tau_j) b_{jp}\sin B_{jp} = 0_{im}\end{aligned}$$

The outputs of 118 and 120 are respectively the real and imaginary parts of the complex output of the processor for the $p^{th}$ sensor. The integrations may be done sequentially if the $f(\tau_j)$ and corresponding $\omega_j$ are inputted in time sequence.

It is required in this case that each argument $\tau_j$ and function $f(\tau_j)$ will be inputted for a time T, the time aperture of the acoustic modulator-deflector 44, FIG. 2, so tha the total integration time (real time) will be mT. If the frequencies $\omega_1, \omega_2, \ldots \omega_j, \ldots \omega_m$, corresponding arguments $\pi_1, ]_2, \ldots \pi_j, \ldots \pi_m$, and sampled function $f(\pi_1), f(\pi_2), f(\pi j), \ldots f(\pi m)$ are inputted simultaneously, then integration over T in 118 and 120 yields the same $O_{re}$ and $O_{im}$. This is true because of terms of the form, $$\int_o^T \sin\left(\frac{2\pi}{T} j_2 t\right) \cos\left(\frac{2\pi}{2} j_2 t\right) dt$$

vanish for all integral values of $j_1$, $j_2$ and terms of the form $$\int_o^T \sin\frac{(2\pi j_1 t)}{T}\sin\frac{(2\pi j_2 t)dt}{T}$$

$$\int_o^T \cos\frac{(2\pi j_1 t)}{T}\cos\frac{(2\omega j_2 t)dt}{T}$$

vanish if $j_1 \neq j_2$. Outputs of 118 and 120, constituting the integral transform of $f(\tau)$, are stored in memory 122. Elements 110, 112, 114, 116 are replicated for each sensor that is implemented. Other elements to the right of line AA need be implemented only once.

Alternatively as indicated by dotted lines, the outputs of multipliers 92 and 96 may be inputted to switch 130, which time-sequentially directs these outputs to multiplier 114, then to integrator 118 (which incorporates the function of integrator 120) and to store or memory 122. Thus multiplier 116 and integrator 120 are by-passed as they are unnecessary. Switch 130 is controlled by frequency generator 94 through counter 132, so that integration over the required time T will be effected in each switch position (for all values of argument $\tau_j$). If sequential output processing is done in this way combined integration time switch 130 can control optical phase shifter 82 in FIG. 2. In this case multiplier 96 and phase shifter 98 may be deleted.

Integrators 118 and 120 may perform analog integration, i.e., accumulate electric charge proportional to $O_{re}$ and $O_{im}$, respectively, for each light sensor. The function of store 122 is to read out 118 and 120 serially and convert the resulting analog time signal to a digital format, which is stored. Alternatively, the data storage function may be bypassed, and integrators 118 and 120 readout to another processing stage.

Further analog operations may be performed prior to storage. A particularly useful operation upon the outputs of 118 and 120 yields the modulus squared by $b_{jp}^2$ of the output of each sensor. Outputs of integration 118 and 120 are squared in multipliers 134 and 132 respectively, which may be multipliers, then summed in summer 138 before being stored in store or memory 122. It is to be noted that all analogue multipliers are "four-quadrant" multipliers, which perform the full algebraic multiplication function.

Figure 4:
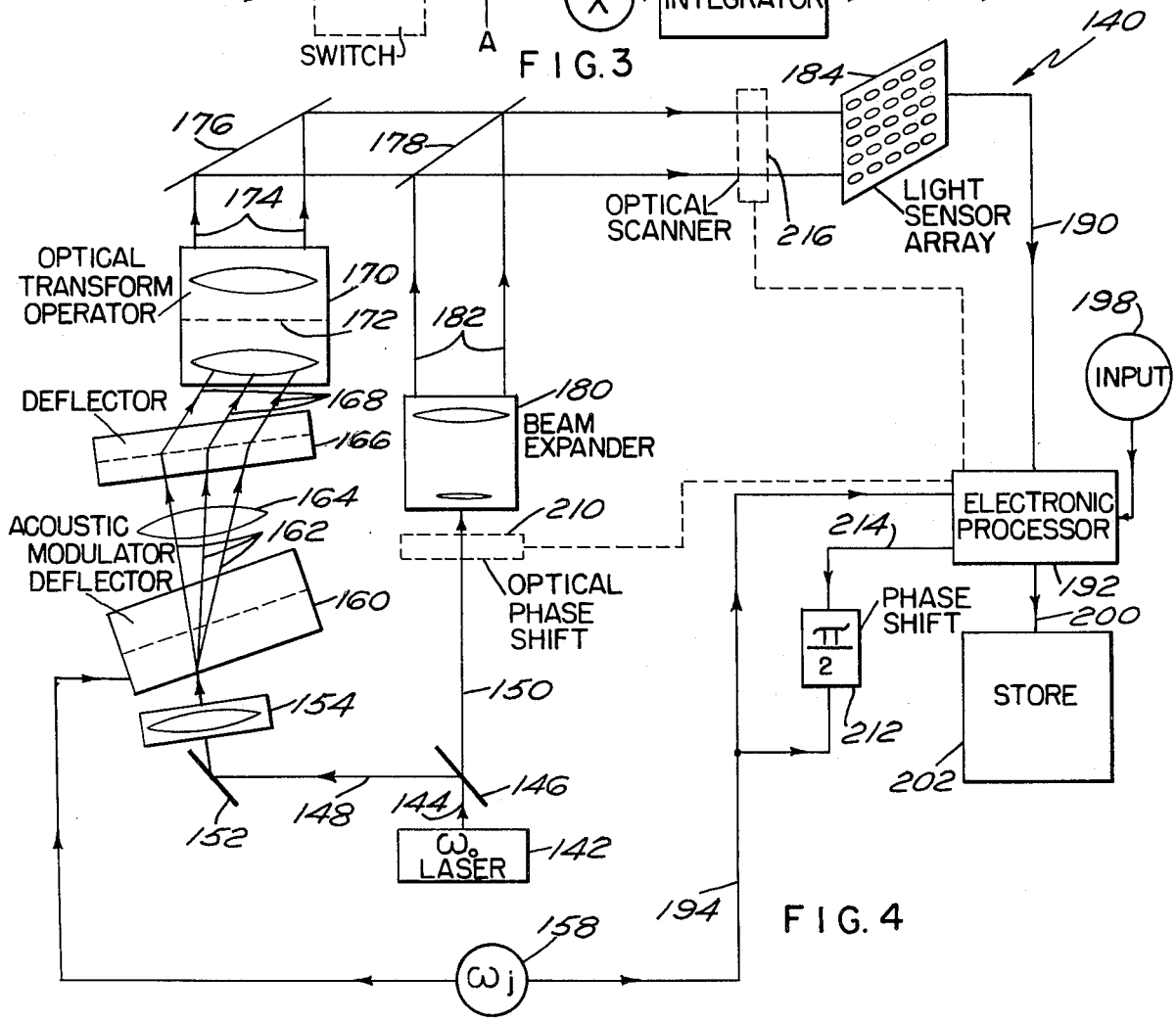
FIG. 4 is a block-diagram of the processor in a form that facilitates the use thereof for input functions of two variables as well as for input functions of one variable.

FIG. 4 is a diagram of the new processor 140 in a form that facilitates the inputting of functions of two variables as well as functions of one variable. Laser 142 generates light beam 144, which has optical frequency $\omega_o$. Beam splitter 146 divides light beam 144 into light beams 148 and 150. Beam 148 is directed by mirror 152 through cylindrical beam expander 154 to acoustic modulator-deflector 160. Subcarrier generator 158 generates m discrete frequencies $\omega_l \ldots \omega_j \ldots \omega_m$ simultaneously and continuously, which frequencies cause traveling waves in acoustic modulator-deflector 160. Each frequency is associated with argument, $x_j$, j=1 . . . m, of an input function. The subcarrier frequencies are large relative to frequencies, which constitute the signal to be operated upon, but are small relative to the optical carrier frequency $\omega_o$. The m frequencies act independently through modulator-deflector 160 to modulate and deflect a set of m light beams 162, which constitute a fan of beams. The acoustic modulator-deflector 160 acts equivalently to a plane grating in diffracting light, i.e., a plane exists from which all light beams appear to be deflected. That plane is imaged by lens 164 onto deflector 166. The light beams are further deflected by deflector 166 in a direction normal to the plane of first deflection by the acoustic modulator-deflector 160. The second deflector 166 may be a mechanical deflector such as a rotating mirror or any equivalent deflector, which impats an angle of deflection that is a function of time, $\tau$. The deflector 166 rotates the fan of acoustically deflected beams 162 through a set of discrete, i.e., resolvable directions, each of which is associated with a $\tau_g$, g-l . . . l. Therefore in time lT, where T is the time required for a wave to propagate through the length of the acoustic modulator-deflector, a two-dimensional set of $l_m$ discrete beams is defined, each of which is associated with a pair of arguments ($x_j$, $\tau_g$). The light beams 168 outputted by deflector 166 then pass through optical integral transform operator 170, which may incorporate filter 172. The optical integral transform operator 170 acts independently on each of the $l_m$ deflected light beams 168. The light beams 174 outputted by the optical integral transform operator are reflected by mirror 176 and through semi-reflecting mirror 178. Beam 150 is expanded by beam expander 180 to become reference beam 182. The reference beam 182 is combined with transformed beam 174 by semi-reflecting mirror 178. The combined transformed beam 174 and reference beam 182 are incident on light sensor array 184, which detects signals that result from interaction of two beams. The alternating current component 190 of the signal outputted by each sensor element of 184 for each pair of argument ($x_j$, $\tau_g$) consists of the subcarrier $\omega_j$ shifted in phase and amplitude by the optical transform operator. The alternating current component 190 is entered into electronic processor 192. Subcarrier frequencies 194 from subcarrier generator 158 and input signals 196 from input signal source 198 are also inputted to electronic processor 192. The electronic processor 192 performs multiplications and summations to output the integral transform 200 of the input signal function to store 202. The operation of the electronic processor 192 has already been described in explanation of FIG. 2. The function of the elements 210, 212, 214 and 216 of FIG. 4 are equivalent to functions of 82, 78, 80 and 75 of FIG. 2.

Figure 5:
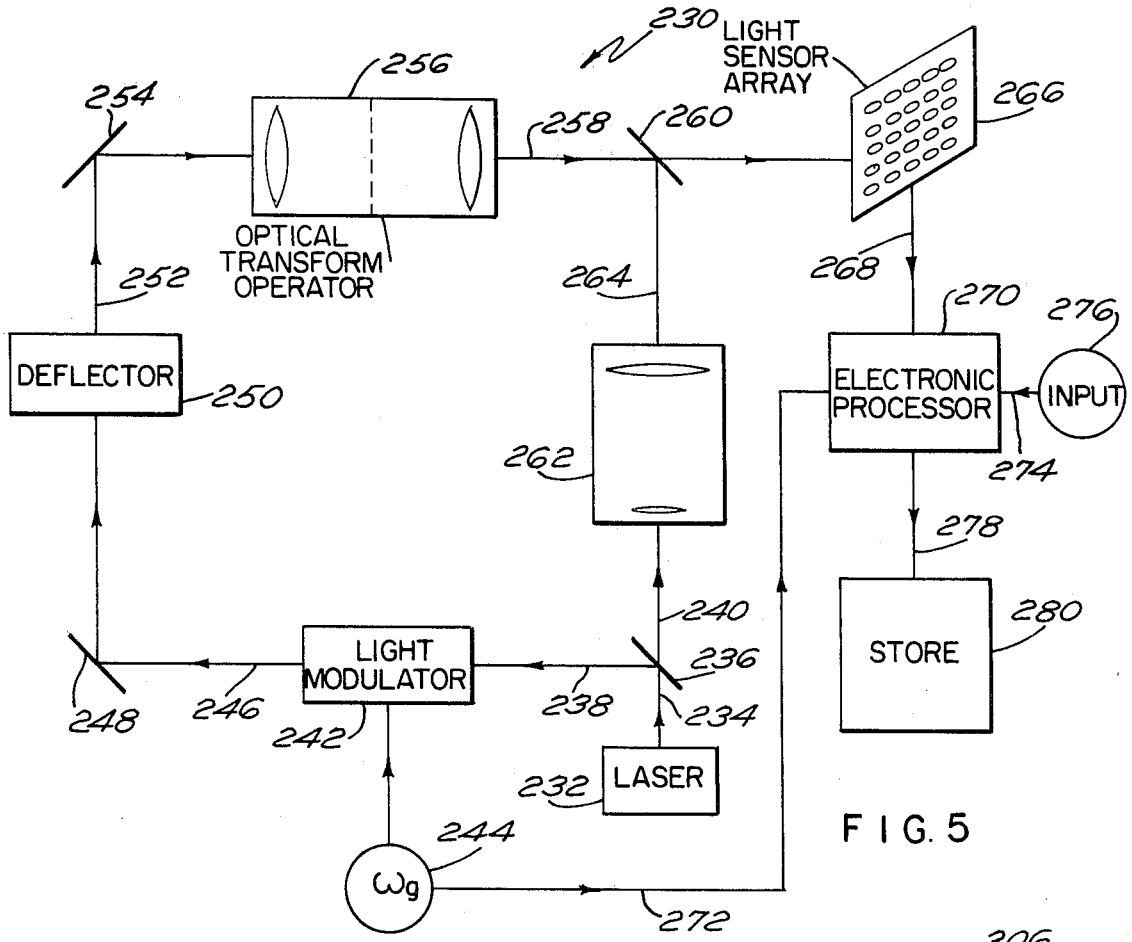
FIG. 5 is a block diagram of the processor where the operation of light modulation by subcarrier is separated from deflection of light.

FIG. 5 shows a form of the processor 230 where the operation of light modulation of subcarrier $\omega_j$ is separated from deflection of light. Laser 232 generates light beam 234 of optical frequency $\omega_o$. Beam splitter 236 divides light beam 234 into light beams 238 and 240. Beam 238 is modulated by light modulator 242 with frequency $\omega_j$ derived from frequency generator 244. The light thereby is phase modulated temporally by a modulation function of from $e^{i\omega_j t}$. A single diffracted beam from an acoustic deflector, for example, is of this form. The light beam 246 from the light modulator 242 is directed by mirror 248 to deflector 250 which may be one or two-dimensional, mechanical, electro-optical, or hybrid. This deflector does not modulate light with a subcarrier frequency. The light beams 252 from the deflector 250 are directed by mirror 254 through the optical integral transform operator 256. The transformed beams 258 pass through semireflector 260. Beam 240 is expanded by beam expander 262 to become reference beam 264 which is combined with transformed beams 258 by semi-reflector 260. The combined transformed beam 258 and reference beam 264 are incident to light sensor array 266, which detects signals that result from interaction of the two light beams. The alternating current component 268 of the signal outputted by each element of 266 at frequency $\omega_j$ is entered into electronic processor 270. The subcarrier frequency 272 from subcarrier generator 244 is entered into electronic processor 270. The input signal 274, which may be one-dimensional or two-dimensional, from input signal source 276 is entered also into the electronic processor 270. The electronic processor performs multiplications and summations as previously described to output the integral transform 278 to store 280.

Figure 6:
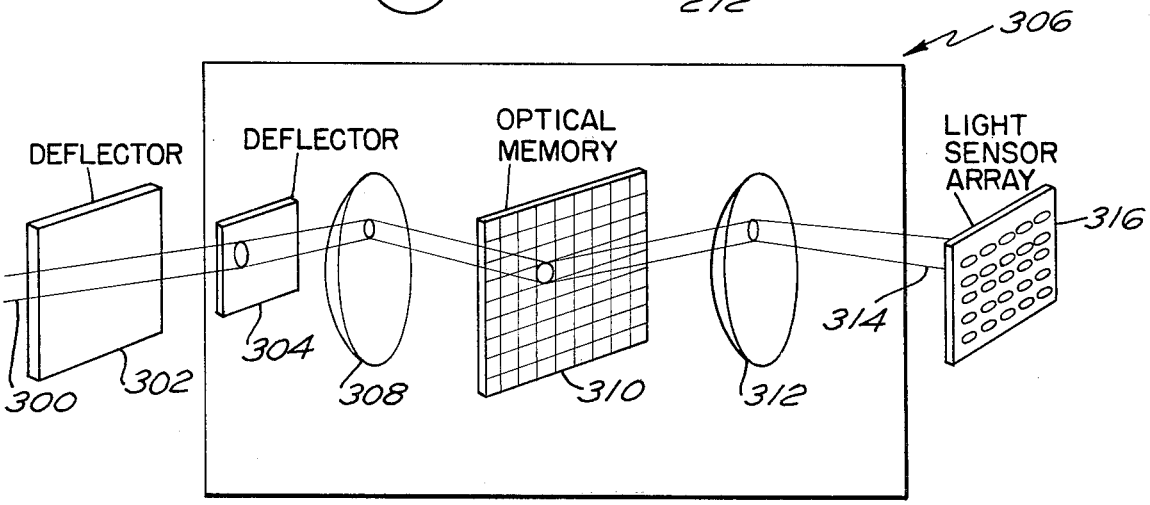
FIG. 6 shows a block diagram of an arrangement for multiplicity of memories using a plurality of optical transform operators.

FIG. 6 shows an embodiment showing an integral transform operator including a large memory or filter comprising a set of sub-memories or filters, each of which stores a limited number of equivalent bits of information. In sequence, each subfilter outputs is transformed beams to the output light sensor array. This sensor array is proportionally smaller than would be needed if the entire memory were addressed by a beam scanning means within the optical transform operator or by means to mechanically translate the memory. As shown in FIG. 6, a laser beam 300 is deflected by deflector 302, which may be an acoustic modulator-deflector. Deflector 304, within the integral transform box 306 further deflects the beam of light through lens 308 to a cell in memory 310, which outputs light beams through lens 312 as transformed beams 314 to light sensor array 316. The reference beam of light and electronic processor, which must also be present, are not represented explicitly in FIG. 6.

In filtering a television picture or equivalent data presented in raster scan format, it is frequently possible to limit the size of the filter (measured by a number of discrete analog elements or by a number of equivalent information bits). If the filter is the Fourier transform of a two-dimensional "spread" function, which convolves with the input picture to yield the output picture, the filter may be much smaller than the equivalent of one complete picture. This restriction is possible if the main lobe of spread function (or inverse transform of the filter) extends over only a small section of the picture, i.e., the equivalent of a few lines in any direction. Referring to FIG. 2 and FIG. 3, the input function $f(\tau_j)$ is a television line. Light beams $\omega_l \ldots \omega_j \ldots \omega_m$, which may be inputted simultaneously or sequentially, correspond to points on the line. The filter 58 may be any two-dimensional light modulator that consists of a limited number of discrete analogue elements. The filter is preferably adaptive. (The purpose or program of filter modification is not part of this disclosure.) The filter could consist of multiple readonly filters as in FIG. 6, which may be selectively addressed to correct or improved the output. Alternatively, the filter may be an electron-beam-addressed two-dimensional light modulator such as a ferro-electric crystal or thermoplastic, or small matrix of independently modulatable elements. The output sensor array of FIG. 2 could then consist of a limited number of lines of sensors, e.g. 11 lines, if the main lobe of the inverse transform of the filter spreads over 11 picture lines. If we number the picture lines as −5, −4, −3, −2, −1, 0, 1, 2, 3, 4, 5, line 0, is then equivalent line in the output to the line now being entered. Sensor lines −5 through −1 provide contributions in the output to the five picture lines just previously entered. Sensor lines 1 through 5 provide contributions in the output to the next five picture lines to be entered. Referring to FIG. 3, the integrators 118 and 120 integrate only over the time required to enter a single line. To obtain $0_{re}$ and $0_{im}$ at each picture line further integration is performed in store 122, which contains locations for all elements of the processed picture. The transfer of output data to store 122 is controlled by frequency generator 94 through counter 132. Frequency generator 94 also controls the input data rate from source 94. To provide for simultaneously readout of the integrators 178 and 120 and readin to the integrators, it may be necessary to employ integrators 118 and 120 alternatively for readin and readout; i.e., 118 accepts input from both 114 and 116, while 120 reads out to 122. Then for the next line 118 and 120 interchange functions. To obtain the output power at each picture element, $(0_{re}^2+0_{im}^2)$, the operations of 134, 136 and 138 are done on the complex output after it is initially accumulated in store 122. The output power may then be returned to store or memory 122 to complete operations on the picture.

Briefly stated, an analog optical processor of subject invention performs complex transform operations or correlations on an input function to yield quantitative output. This is accomplished on data points of the input function which are used as inputs serially or simultaneously. The dynamic range of the input function that may be operated upon is not limited by the characteristics of a medium on which the input function is recorded or stored and by the characteristics of a discrete electro-optical sensor.

Obviously, many modifications and variations of the present invention may become apparent in the light of the above teachings. As an example, it is possible to multiply the signal applied to the acoustic modulator-deflector by the input function, thus eliminating some of the multipliers used in FIG. 3. Furthermore, modulation of light by a Bragg acoustic device can be accomplished by another appropriate device. Besides, the optical integral transform operator may be a fixed parameter device including lenses and fixed read-only memory. Alternatively, the memory may be read-only, but addressable in sections by deflections of light or by moving the memory. Furthermore, the integral transform operator may also incorporate a read-write memory, addressable by light or by an electron beam. It is therefore understood that within the scope of the appended claims the invention may be practiced otherwise than as specifically described.

What is claimed is:

1. An optical homodyne processor for performing complex transform operations on input functions which comprises:

laser means for generating a beam of light to be used as a reference beam and as an argument of the input functions;

a subcarrier frequency source generating frequencies substantially lower than the frequency of the laser beam;

acoustic modulator deflector means for obtaining a plurality of arguments of the input functions using said subcarrier frequency source and said beam of light as the output of the acoustic modulator deflector;

optical transform operator means for operating on the output of said acoustic modulator deflector means so as to accomplish spatial modulation of the output of said acoustic modulator deflector means and to obtain optical readout thereof;

a matrix of a plurality of light sensors for reading the optical readout of said optical transform operator means combined with the reference beam;

electronic processor means for multiplying the input functions with the output of said matrix of a plurality of light sensors and integrating the result to obtain an output thereof;

storage means for storing the output of said electronic processor.

2. The optical processor of claim 1 wherein said optical transform operator means includes a complex transform filter.

3. The optical processor of claim 1 wherein the input functions to be operated upon are functions of one variable.

4. The optical processor of claim 2 wherein said matrix of a plurality of light sensors includes a plurality of photodiodes.

5. The optical processor of claim 1 which uses a plurality of optical transform operators for a system using multiple memories.

6. The optical processor of claim 4 wherein said electronic processor includes a plurality of electronic multipliers.

7. The optical processor of claim 6 wherein said electronic processor further includes a plurality of electronic integrators.

8. The optical processor of claim 6 which further includes beam expander means in the path of the reference light beam before it is mixed with the output of said optical transform operator means.

9. The optical processor of claim 8 wherein input functions to be operated upon by the optical transform operator include functions of two variables.

10. The optical processor of claim 9 wherein the acoustic modulator deflector means includes a Bragg cell.

* * * * *